US007614346B2

(12) United States Patent
Kienzler et al.

(10) Patent No.: US 7,614,346 B2
(45) Date of Patent: Nov. 10, 2009

(54) PROJECTILE FUZE WITH FUZE ELECTRONICS INCLUDING A TIMER/COUNTER

(75) Inventors: Frank Kienzler, Villingen-Schwenningen (DE); Wolfgang Schillinger, Schiltach (DE); Wolfgang Zehnder, Schramberg (DE); Reiner Hennig, Mönchweiler (DE); Esther Laufer, Rottweil (DE); Siegfried Paulini, Eppelborn (DE)

(73) Assignee: Junghans Microtech GmbH, Dunningen-Seedorf (DE)

( * ) Notice: Subject to any disclaimer, the term of this patent is extended or adjusted under 35 U.S.C. 154(b) by 0 days.

(21) Appl. No.: 11/857,535

(22) Filed: Sep. 19, 2007

(65) Prior Publication Data

US 2008/0078299 A1 Apr. 3, 2008

(30) Foreign Application Priority Data

Oct. 2, 2006 (DE) ..... 10 2006 046 811

(51) Int. Cl.
*F42C 15/34* (2006.01)
*F42C 15/24* (2006.01)

(52) U.S. Cl. ..... 102/222; 102/248; 102/251; 102/262; 102/264

(58) Field of Classification Search ..... 102/202.6, 102/222, 248, 251, 262, 264
See application file for complete search history.

(56) References Cited

U.S. PATENT DOCUMENTS

| | | | | |
|---|---|---|---|---|
| 3,451,340 | A | 6/1969 | Batou | |
| 4,145,971 | A * | 3/1979 | Graham et al. | 102/232 |
| 4,334,475 | A | 6/1982 | Turchi | |
| 5,063,847 | A | 11/1991 | Halssig et al. | |
| 5,693,906 | A | 12/1997 | Van Sloun | |
| 6,463,855 | B2 * | 10/2002 | Zehnder et al. | 102/223 |
| 6,883,434 | B2 * | 4/2005 | Kienzler et al. | 102/221 |
| 2001/0017090 | A1 * | 8/2001 | Zehnder et al. | 102/223 |
| 2004/0144278 | A1 * | 7/2004 | Kienzler et al. | 102/221 |
| 2004/0144279 | A1 * | 7/2004 | Glatthaar et al. | 102/221 |
| 2006/0260499 | A1 * | 11/2006 | Westphal et al. | 102/254 |
| 2007/0051266 | A1 * | 3/2007 | Zinell et al. | 102/237 |

FOREIGN PATENT DOCUMENTS

| | | |
|---|---|---|
| DE | 200 23 637 U1 | 9/2000 |
| DE | 101 33 832 B4 | 7/2001 |
| EP | 1 225 418 A1 | 7/2002 |

* cited by examiner

*Primary Examiner*—Bret Hayes
*Assistant Examiner*—Michael D David
(74) *Attorney, Agent, or Firm*—Scully, Scott, Murphy & Presser, P.C.

(57) ABSTRACT

A projectile fuze (12) having fuze electronics in which the time of flight (T) can be programmed, having a timer/counter which counts up to the programmed time of flight (T)—minus a defined time value (Δt)—and then charges an electrical firing circuit, and having a mechanical safety and arming unit (16) which switches a firing chain to the armed position after a specific time interval. The firing chain has an electrical detonator (24), a fuze needle (20), a piercing detonator (22) and a booster charge (26). The projectile fuze (12) has a pyrotechnic force element (14), which is interconnected with the fuze electronics and mechanically blocks the safety and arming unit (16) until the time of flight (T) minus the predetermined time value (Δt) is reached, after which the electrical firing circuit is charged and the safety and arming unit (16) is unlocked to the armed position by initiation of the force element (14).

3 Claims, 3 Drawing Sheets

PROJECTILE FUZE WITH FUZE ELECTRONICS INCLUDING A TIMER/COUNTER

BACKGROUND OF THE INVENTION

1. Field of the Invention

The invention relates to a projectile fuze in which the time of flight (T) can be programmed, having a timer/counter which counts up to the programmed time of flight (T)—minus a defined time value (Δt)—and then charges an electrical firing circuit. A mechanical safety and arming unit switches the firing circuit, which has an electrical detonator, a firing needle, a piercing detonator and a booster charge, to an armed position after a specific time interval. The projectile fuze, for example, may be used as a mortar fuze.

2. Discussion of the Prior Art

Projectile fuzes are known which possess a so-called overflight safety. Such an overflight safety has been introduced in the form of an electrical solution, for example, for a fuze with the type designation ANNZ DM 74. This known overflight safety is used to make the projectile fuze resistant to jamming attempts and/or to spoofing attempts by an enemy, and against rarely occurring influences, both external and internal, over a relatively long section of the projectile trajectory. The so-called trajectory decomposition rate for known projectile fuzes such as these is less than $10^{-6}$. This means that a projectile fitted with a projectile fuze such as this can now even be used over one's own troops. This applies, for example, to exercises using projectiles which are equipped with projectile fuzes such as these.

Electrical overflight safety such as described is achieved by programming, that is to say feeding the time of flight of the projectile into the fuze electronics by means of an external programmer. Once the projectile has been fired, a timer/counter is started, which counts up to the programmed time of flight—minus a defined time value—and then charges an electrical firing circuit for the fuze electronics. The time required to charge the firing circuit in this manner is in the region of milliseconds, so that the projectile fuze is ready to fire in good time at the predetermined target.

However, in the case of the known projectile fazes of the type mentioned above, the safety and arming unit is designed such that, even after a time interval which is very short in comparison to the overall trajectory, the mechanical interruption in the firing chain is removed, that is to say the so-called safe separation distance is comparatively short.

SUMMARY OF THE INVENTION

Accordingly, in view of the foregoing, the invention is based on the object of providing a projectile fuze of the type mentioned initially, which has a programmable electrical and mechanical overflight safety and a comparatively long safe separation distance.

According to the invention, this object is achieved in that the fuze is provided with a pyrotechnic force element, which is interconnected with the fuze electronics and mechanically blocks a safety and arming unit until there is reached the time of flight (T) minus the predetermined time value (Δt), after which the firing circuit is charged and the safety and arming unit is unlocked to the armed position by initiation of a force element.

Preferred refinements and developments of the projectile fuze according to the invention are set forth in the dependent claims.

In the case of the projectile fuze according to the invention, the safety and arming unit is blocked by a pyrotechnic force element, that is, in effect, it is held firmly in the safe position, until the time of flight which has been programmed, or else if necessary, has been set manually—minus a defined time value (overflight safety)—is reached. Once the selected time of flight minus the defined time value has been reached, then the firing circuit for the force element is charged, and the safety and arming unit is unlocked by initiation of the force element. The safety and arming unit then moves to the armed position, that is, the interruption is removed from the firing chain, and the firing chain is then in-line. The actual firing circuit of the projectile fuze according to the invention is now charged, so that the fuze is ready to fire in good time at the intended target.

BRIEF DESCRIPTION OF THE DRAWINGS

Further details, features and advantages will become evident from the following description of two exemplary embodiments, which are illustrated in the drawings, of the projectile fuze according to the invention; and wherein.

DETAILED DESCRIPTION OF THE INVENTION

Figure 1:
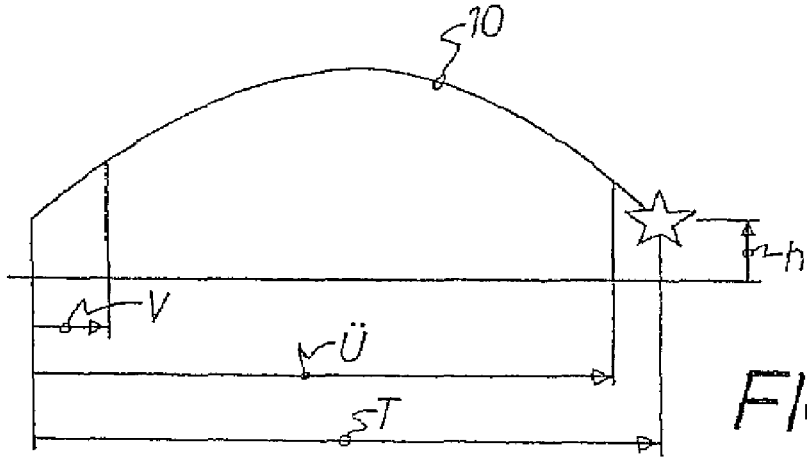
FIG. 1 shows a schematic illustration of a trajectory of a projectile with a known projectile fuze.

FIG. 1 shows a trajectory 10 of a projectile which has a conventional projectile fuze, with the arrow V indicating the safe separation distance, the arrow Ü indicating the overflight safety and the arrow T the time of flight or target range. The initiation height of the projectile fuze is annotated h.

Figure 2:
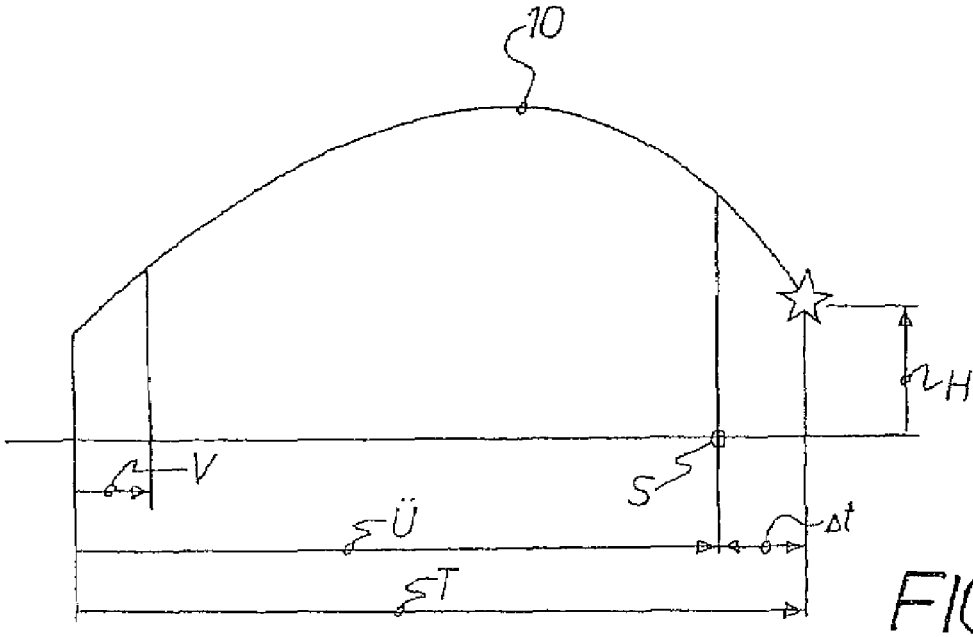
FIG. 2 shows an illustration, similar to FIG. 1, of the trajectory of a projectile with a projectile fuze according to the invention.

In an illustration similar to FIG. 1, FIG. 2 shows the trajectory 10 of a projectile which has a projectile fuze according to the invention, with the arrow V once again denoting the mechanical safe separation distance and the arrow T the time of flight or target range. H in FIG. 2 denotes the firing altitude of the projectile fuze. The arrow Ü denotes the overflight safety in FIG. 2 as well, although this relates to electrical/mechanical overflight safety, with the point S denoting the point at which the safety and arming unit of the projectile fuze is armed.

Figure 3:
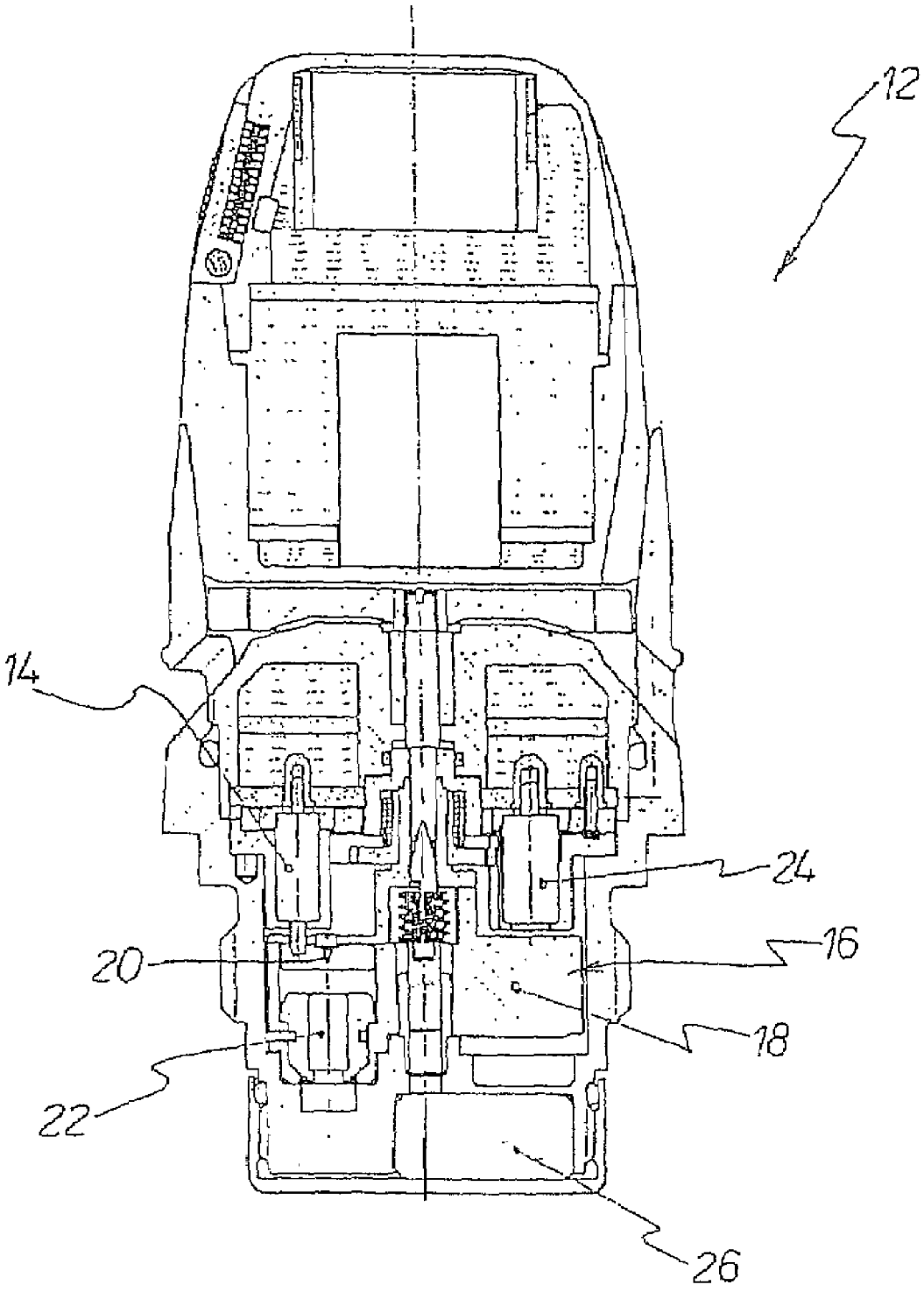
FIG. 3 shows a longitudinal section through a first embodiment of the projectile fuze according to the invention.

FIG. 3 shows a longitudinal section illustration of one embodiment of the projectile fuze 12 according to the invention, which has a pyrotechnic force element 14 which is interconnected with fuze electronics, and which blocks the safety and arming unit 16 until the time of flight T—minus a predetermined time value Δt (see FIG. 2)—is reached. As soon as this is the case, a firing circuit for the projectile fuze 12 is electrically charged, and the safety and arming unit 16 is unlocked to the armed position, by initiation of the pyrotechnic force element 14. FIG. 3 shows the safety and arming unit in the safe position.

The safety and arming unit 16 has a rotor 18 with a fuze needle 20 and with a piercing detonator 22. The fuze needle 20 and the piercing detonator 22 are axially aligned with one another, and are at a distance from one another.

The projectile fuze 12 has an electrical detonator 24 which is interconnected with the fuze electronics.

The projectile fuze 12 also has a booster charge 26, which is associated with the electrical detonator 24. The rotor 18 is provided between the electrical detonator 24 and the booster charge 26.

While in the safe position as shown in FIG. 3, the fuze needle 20 and the piercing detonator 22 are not in line with the electrical detonator 24 and the booster charge 26. The electrical detonator 24, the fuze needle 20, the piercing detonator 22 and the booster charge 26 are in an axially aligned position, that is to say they are in line, when the projectile fuze 12 is in the armed position, as a result of the rotor 18 having been rotated through 180°.

Figure 4:
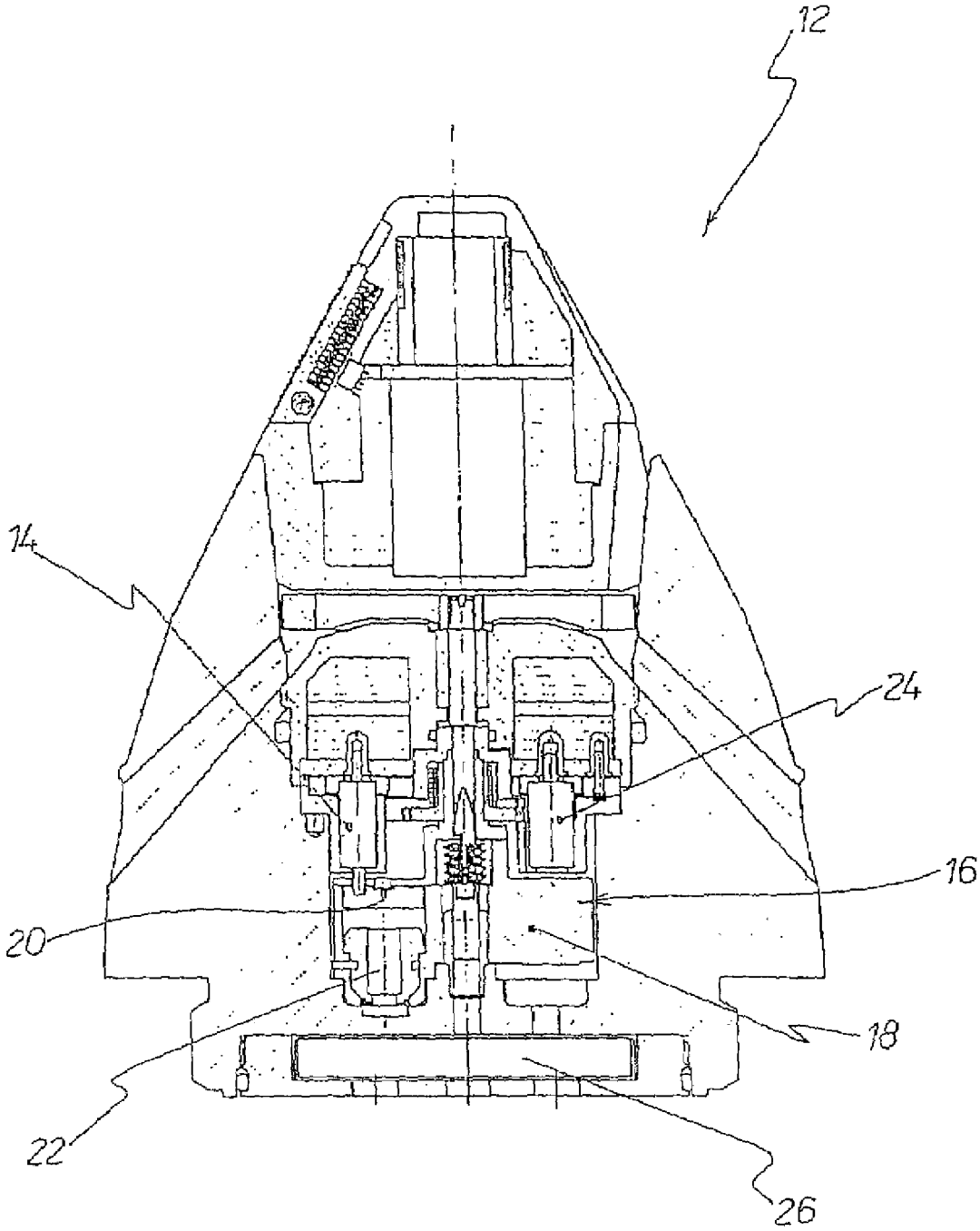
FIG. 4 shows a longitudinal section illustration of a second embodiment of the projectile fuze according to the invention.

FIG. 4 represents a longitudinal section illustration, similar to that in FIG. 3, of another embodiment of the projectile fuze 12 according to the invention, with the same details being annotated with the same reference numbers as in FIG. 3, so that there is no need to describe all of these details once again in conjunction with FIG. 4.

LIST OF REFERENCE SYMBOLS

10 Trajectory
12 Projectile fuze
14 Pyrotechnic force element (of 12)
16 Safety and arming unit (of 12)
18 Rotor (of 16)
20 Fuze needle (on 18)
22 Piercing detonator (on 18)
24 Electrical detonator (of 12)
26 Booster charge (of 12)

What is claimed is:

1. A projectile fuze having fuze electronics in which the time of flight (T) is programmable, including a timer/counter which counts up to the programmed time of flight (T)—minus a defined time value (Δt) where upon said timer/counter charges an electrical firing circuit, a mechanical safety and arming unit (16) configuring to switch a firing chain which includes an electrical detonator (24), a firing needle (20), a piercing detonator (22) and a booster charge (26), from a safe to an armed position of the safety and arming unit after a specific time interval, and a pyrotechnic force element (14), which is operatively connected with the fuze electronics and mechanically blocks the safety and arming unit (16) until there is reached the time of flight (T) minus the defined time value (Δt), where upon the electrical firing circuit is charged and the safety and arming unit (16) is unblocked so as to assume the armed position by initiation of the force element (14).

2. A projectile fuze according to claim 1, wherein the safety and arming unit (16) has a rotor (18) with a faze needle (20) and a piercing detonator (22), the faze needle (20) and the piercing detonator (22) being axially aligned with each other and separated from each other.

3. A projectile faze according to claim 2, wherein the fuze electronics are interconnected with the electrical detonator (24), which is separated from the booster charge (26), and wherein the rotor (18) is arranged between the electrical detonator (24) and the booster charge (26).

* * * * *